US006644271B1

(12) United States Patent
Cotton, III

(10) Patent No.: US 6,644,271 B1
(45) Date of Patent: Nov. 11, 2003

(54) ENGINE BRAKING SYSTEM

(75) Inventor: Clifford E. Cotton, III, Pontiac, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/283,336

(22) Filed: Oct. 30, 2002

(51) Int. Cl.[7] ..... F02D 13/04

(52) U.S. Cl. ..... 123/321; 123/322; 123/90.12; 123/90.13

(58) Field of Search ..... 123/321, 322, 123/90.12, 90.13

(56) References Cited

U.S. PATENT DOCUMENTS

| | | | | |
|---|---|---|---|---|
| 3,220,392 A | | 11/1965 | Cummins | 123/97 |
| 4,174,687 A | | 11/1979 | Fuhrmann | 123/90.13 |
| 4,655,254 A | | 4/1987 | Hafner et al. | 137/625.65 |
| 5,012,778 A | | 5/1991 | Pitzi | 123/321 |
| 5,224,683 A | | 7/1993 | Richeson | 251/30.01 |
| 5,526,784 A | | 6/1996 | Hakkenberg et al. | 123/322 |
| 5,586,532 A | | 12/1996 | Faletti et al. | 123/321 |
| 5,996,550 A | * | 12/1999 | Israel et al. | 123/322 |
| 6,125,828 A | * | 10/2000 | Hu | 123/321 |
| 6,240,898 B1 | * | 6/2001 | Meistrick et al. | 123/321 |
| 6,321,701 B1 | * | 11/2001 | Vorih et al. | 123/90.12 |
| 6,446,598 B1 | * | 9/2002 | Funke et al. | 123/321 |
| 6,453,873 B1 | | 9/2002 | Funke et al. | 123/322 |
| 6,510,824 B2 | * | 1/2003 | Vorih et al. | 123/90.12 |
| 6,516,775 B2 | * | 2/2003 | Cornell et al. | 123/321 |
| 2002/0056435 A1 | * | 5/2002 | Yang et al. | 123/322 |

* cited by examiner

*Primary Examiner*—Erick Solis
(74) *Attorney, Agent, or Firm*—Finnegan, Henderson, Farabow, Garrett & Dunner

(57) ABSTRACT

An engine braking system for a multi-cylinder engine includes a supply of low pressure fluid and an engine fluid sump. A plurality of valve actuators are each configured to be alternatively fluidly coupled to the supply of low pressure fluid and the engine fluid sump. Each valve actuator is operably coupled to at least one exhaust valve for a respective cylinder. The system also includes a braking control valve operably coupled to two of the valve actuators. The braking control valve is movable between a first position at which the two valve actuators are fluidly coupled to the engine fluid sump and blocked from the supply of low pressure fluid and a second position at which the two valve actuators are fluidly coupled to the supply of low pressure fluid and blocked from the engine fluid sump.

20 Claims, 2 Drawing Sheets

ENGINE BRAKING SYSTEM

TECHNICAL FIELD

This invention relates generally to engine braking systems and methods and, more particularly, to a control valve for engine braking systems and methods.

BACKGROUND

Engine brakes, or engine retarders, are sometimes used to assist and supplement wheel brakes in slowing heavy vehicles, such as dump trucks, construction vehicles, tractor-trailers, and the like. Engine compression brakes convert an internal combustion engine from a power generating unit into a power consuming air compressor. Compressed air from the compression stroke of the engine is released through the cylinder exhaust valve when the piston in the cylinder nears the top-dead-center position. In conjunction with the increasingly widespread use of electronic controls in engine systems, engine braking systems have been developed which are electronically controlled by a central engine control unit.

U.S. Pat. No. 3,220,392 issued to Cummins on Nov. 30, 1965, discloses an engine braking system in which an exhaust valve located in a cylinder is opened when the piston in the cylinder nears the top-dead-center position on the compression stroke. An actuator includes a master piston, driven by a cam and pushrod, which in turn drives a slave piston to open the exhaust valve during engine braking. The actuator is controlled by a hydraulic circuit requiring at least one control valve and at least one solenoid valve for each cylinder.

Thus, the Cummins device requires manufacture, assembly, warranty, and maintenance of these numerous valves. Each of these concerns comes at an expense to the manufacturer and the user. Furthermore, the numerous valves and associated plumbing occupy space in the engine compartment, thus increasing the size of the engine, the weight of the engine, and the gross weight of the associated vehicle.

The present invention provides an economical and reliable engine braking system that avoids one or more of the aforesaid shortcomings in the prior art.

SUMMARY OF THE INVENTION

In accordance with one aspect of the invention, an engine braking system for a multi-cylinder engine includes a supply of low pressure fluid and an engine fluid sump. A plurality of valve actuators are each configured to be alternatively fluidly coupled to the supply of low pressure fluid and the engine fluid sump. Each valve actuator is operably coupled to at least one exhaust valve for a respective cylinder. The system also includes a braking control valve operably coupled to two of the valve actuators. The braking control valve is movable between a first position at which the two valve actuators are fluidly coupled to the engine fluid sump and blocked from the supply of low pressure fluid and a second position at which the two valve actuators are fluidly coupled to the supply of low pressure fluid and blocked from the engine fluid sump.

In accordance with another aspect of the invention, an engine braking method for a multi-cylinder engine is provided. Compressed air from the compression stroke of a cylinder is used for engine braking and the compressed air is released through a cylinder exhaust valve near a piston top-dead-center position. The method includes supplying fluid from a supply of low pressure fluid to a braking control valve and selectively controlling movement of the braking control valve between a first position at which two valve actuators are fluidly coupled to an engine fluid sump and blocked from the supply of low pressure fluid and a second position at which the two valve actuators are fluidly coupled to the supply of low pressure fluid and blocked from the engine fluid sump. Each of the valve actuators controls an exhaust valve of a different cylinder.

In accordance with yet another aspect of the invention, an engine braking system for two cylinders of a multi-cylinder engine includes a supply of low pressure fluid, an engine fluid sump, and a valve actuator operably coupled to each cylinder. Each of the valve actuators is configured to be alternatively fluidly coupled to the supply of low pressure fluid and the engine fluid sump. The system also includes a braking control valve operably coupled to two of the valve actuators. The braking control valve is movable between a first position at which the two valve actuators are fluidly coupled to the engine fluid sump and blocked from the supply of low pressure fluid and a second position at which the two valve actuators are fluidly coupled to the supply of low pressure fluid and blocked from the engine fluid sump. A check valve is associated with each of the valve actuators. Each check valve is configured to prevent fluid flow from the respective valve actuator to the supply of low pressure fluid. At least one exhaust valve is operably coupled to each valve actuator.

DETAILED DESCRIPTION

Figure 1:
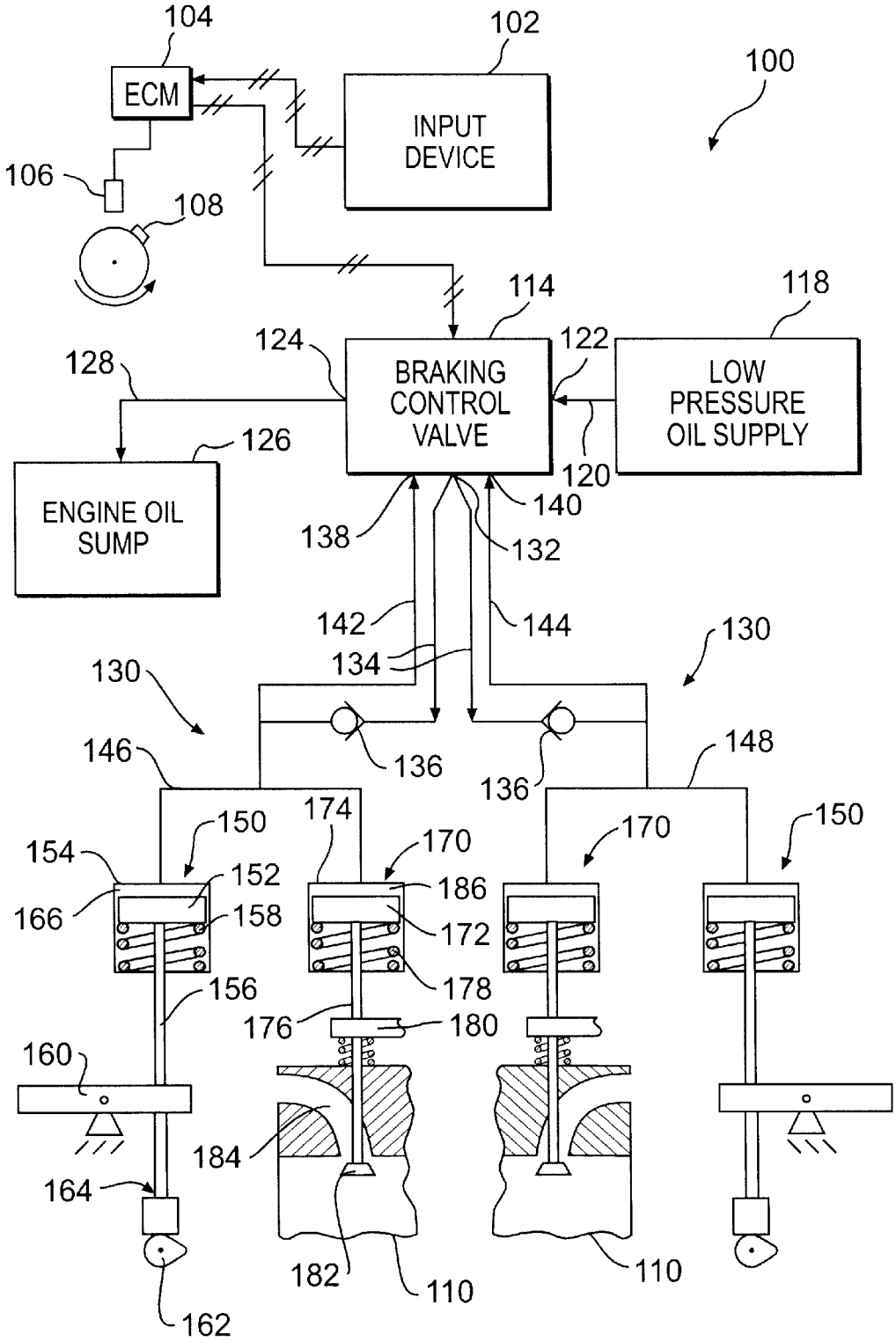
FIG. 1 is a schematic illustration of an engine braking system according to an exemplary embodiment of the present invention.

Referring now to FIG. 1, an engine braking system 100, for example, an engine compression braking system, for a multi-cylinder engine (not shown) is disclosed. The engine braking system 100 includes an input device 102 electrically coupled to an electronic control module (ECM) 104. The input device 102 may be, for example, a selectively switchable control available in an operator compartment of a vehicle, an automatic switch associated with a vehicle brake pedal, or any known method of providing an input signal. Optionally, the engine braking system 100 may include a sensor 106 configured to sense a crankshaft position indicator 108. The indicator 108 may be correlated to a top-dead-center position of each piston (not shown) in a cylinder 110 of the engine.

The ECM 104 is electrically coupled to one or more braking control valves 114. Although only one braking control valve 114 and two cylinders 110 are shown for simplicity, it should be understood that more than one braking control valve may be required for an engine having more than two cylinders, as will be discussed below.

The engine braking system 100 further includes a supply 118 of hydraulic fluid, such as oil, at low pressure. The low pressure oil supply 118 may be the lubrication oil passed through the engine gallery to lubricate bearings and other engine components. The braking control valve 114 may include a supply port 122 fluidly coupled to the low pressure supply 118 via a hydraulic line 120. The braking control valve 114 may also include a vent port 124 fluidly coupled to an engine fluid sump 126 via a hydraulic line 128.

The engine braking system 100 also includes a valve actuator 130, for example, a master/slave piston assembly, associated with each cylinder of the engine. The braking control valve 114 may include an actuation port 132 fluidly coupled to a pair of valve actuators 130 via a pair of hydraulic manifolds 134. Each manifold 134 may include a check valve 136 arranged to prevent fluid flow back to the braking control valve 114. It should be appreciated that the pair of manifolds 134 may be combined between the check valve 136 and the actuation port 132, but one check valve 136 is associated with each valve actuator 130 to independently provide pressurized fluid to actuator manifolds 146, 148 associated with each of the valve actuators 130.

The braking control valve 114 may also include two drain ports 138, 140 fluidly coupled to the pair of valve actuators 130 via a pair of hydraulic lines 142, 144. The hydraulic lines 142, 144 are separately coupled to the two drain ports 138, 140 to avoid unintentional actuation of the actuator associated with one cylinder by return fluid flow from the actuator associated with another cylinder.

Each valve actuator includes a first piston assembly 150 and a second piston assembly 170. The first piston assembly 150 includes a piston 152 slidable in a housing 154. The piston 152 may be coupled with a plunger 156 and a spring 158 arranged to urge the piston 152 in a first direction. The plunger 156 may be mechanically coupled to a rocker arm 160 associated with, for example, a fuel injection system (not shown). It should be appreciated that the rocker arm 160 may be independent of the fuel injection system. The rocker arm 160 may be mechanically coupled to a rotatable cam 162, for example, a cam that determines fuel injection timing, and an associated cam follower 164 so as to transfer rotational motion of the cam 162 to linear motion of the piston 152 in the first direction. The piston 152 and the housing 154 define a first pressure chamber 166 in fluid communication with an actuator manifold 146 or 148.

The second piston assembly 170 includes a piston 172 slidable in a housing 174. The piston 172 may be coupled with a plunger 176 and a spring 178 arranged to urge the piston 172 in a first direction. The plunger 176 may be mechanically coupled to a rocker arm 180 associated with an exhaust valve 182. The rocker arm 180 may be mechanically coupled to a rotatable camshaft, cam, and associated cam follower (not shown) so as to transfer rotational motion of the camshaft to linear motion of the exhaust valve 182 for opening and closing an exhaust outlet 184 of the cylinder 110, as is well known in the art. The piston 172 and the housing 174 define a second pressure chamber 186 in fluid communication with an actuator manifold 146 or 148.

Figure 2:
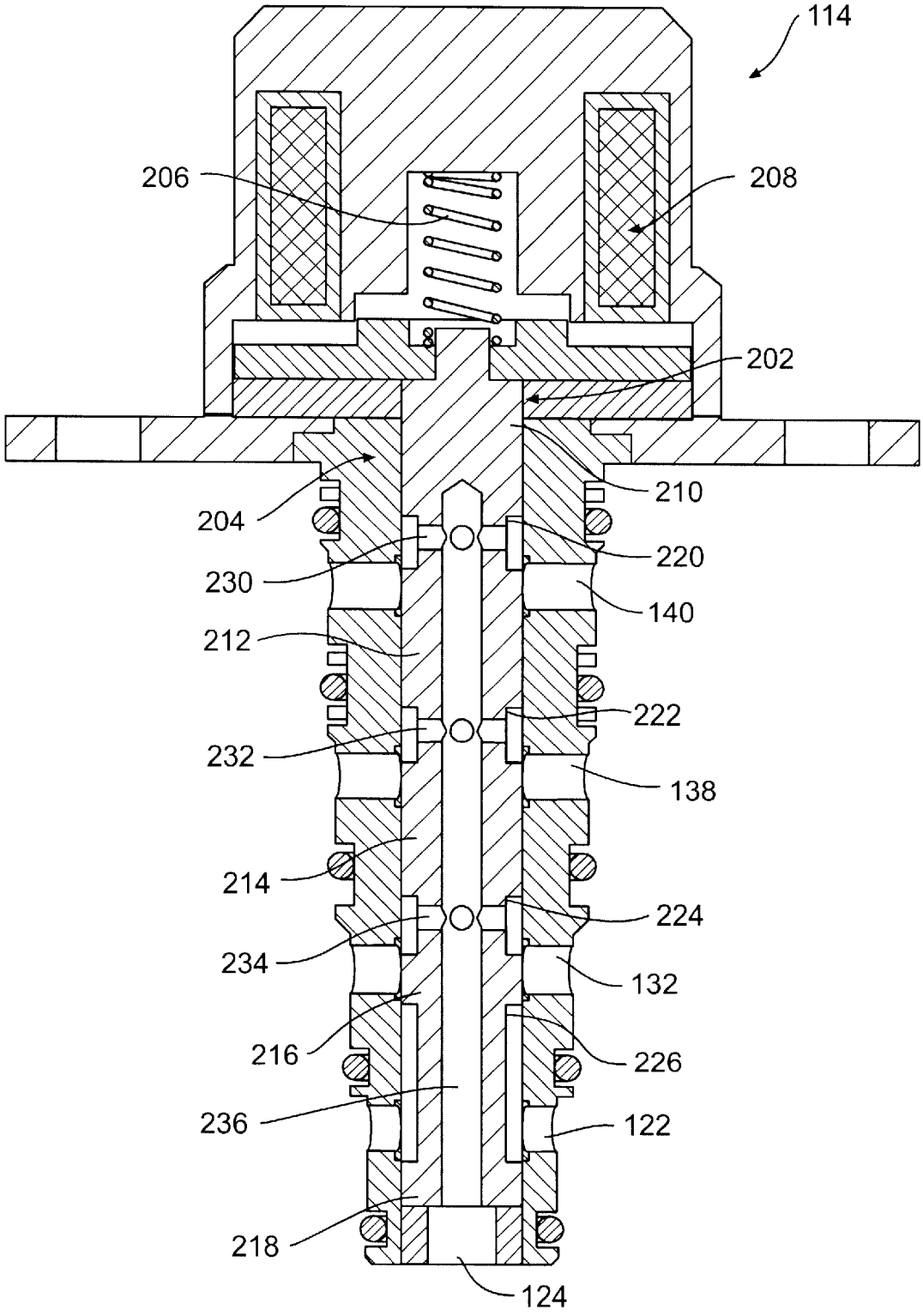
FIG. 2 is a cross-sectional diagrammatic view of a brake control valve of the engine braking system shown in FIG. 1.

Referring now to FIG. 2, the braking control valve 114 includes a spool valve 202 slidable in a valve body 204. The braking control valve 114 may also include a spring 206 urging the spool valve 202 in a first direction toward a closed position of the braking control valve 114. The braking control valve 114 may further include a solenoid 208 arranged to operate the braking control valve 114 to move the spool valve 202 in a second direction, opposite the first direction and opposite the spring force, toward an open position of the braking control valve 114.

The spool valve 202 includes a series of lands 210, 212, 214, 216, 218 delimiting a series of annuluses 220, 222, 224, 226. The annuluses 220, 222 are arranged on the valve 202 to fluidly communicate with the respective drain ports 140, 138 when the braking control valve 114 is in the closed position (FIG. 2). The annuluses are also arranged such that the fluid communication with respective ports 140, 138 ceases when the braking control valve is in an open position (not shown).

The annulus 226 is always in fluid communication with the supply port 122. When the braking control valve 114 is in an open position, the annulus 226 also fluidly couples the actuation port 132 with the supply port 122. Optionally, the annulus 224 may be in fluid communication with the actuation port 132 when the braking control valve 114 is in a closed position. This optional fluid communication allows drainage from the hydraulic manifold 134, for example, when the engine is turned off.

The spool valve 202 also includes a plurality of radial throughholes 230, 232, 234 arranged to fluidly couple a respective annulus 220, 222, 224 to a longitudinal bore 236. Each throughhole 230, 232, 234, may include a pair of throughholes perpendicular to one another. The longitudinal bore 236, in turn, is fluidly coupled to the vent port 124.

It should be appreciated that a 6-cylinder engine having one exhaust valve per cylinder would have 6 exhaust valves and 6 exhaust valve actuators. Thus, for such a 6-cylinder engine, the engine braking system 100 may include three braking control valves 114 if all six cylinders are to be used for engine braking. On the other hand, a 6-cylinder engine having two exhaust valves per cylinder would have twelve exhaust valves and twelve exhaust valve actuators. However, the two exhaust valves for each cylinder could be bridged so that one actuator would drive both exhaust valves in one cylinder.

It should further be appreciated that the input device 102 may be an operator-switchable input that may provide an on/off signal or that may provide a variable braking signal. For example, in a 6-cylinder engine, the input device 102 may be switchable between off, 2-cylinder, 4-cylinder, and 6-cylinder positions, such that the amount of engine braking can be varied.

Industrial Applicability

In operation, the ECM 104 may enter an engine braking mode in response to a signal from the input device 102. During an engine braking mode, fuel supply to the engine cylinders 110 used for engine braking should be stopped. The ECM 104 may receive signals from the sensor 106 to attain appropriate timing during the engine braking mode such that compressed air is released from the cylinder 110 through the exhaust outlet 184 when the piston is near a top-dead-center position.

In the engine braking mode, the ECM 104 energizes the solenoid 208, which moves the braking control valve 114 from a first, closed position to a second, open position. Energizing the solenoid 208 causes the spool valve 202 to move in a direction opposite to the force of the spring 206 (upward in FIG. 2) to fluidly couple the supply port 122 and the actuation port 132. In addition, the spool valve 202 blocks fluid communication between the drain ports 138, 140 and the sump 126. As a result, hydraulic fluid from the low pressure supply 118 flows to the hydraulic manifolds 134 and is available for use by the valve actuators 130.

If the pressure of hydraulic fluid in a hydraulic manifold 130 is high enough to open the associated check valve 136, then the fluid may flow to the associated actuator manifold 146 or 148 and return line 142 or 144, as well as to the first pressure chamber 166 and the second pressure chamber 186. The check valves 136 may be structured and arranged to allow fluid flow from the hydraulic manifold 130 when the pressure of fluid in the associated actuator manifold and return line drops below a predetermined pressure. Therefore, at least the predetermined pressure is kept available to the valve actuators 130.

At times when the braking control valve 114 is in the second position, the "master" piston assembly 150 may act as a pump, providing pressurized fluid to the "slave" piston assembly 170. For example, linear movement of the piston 152 of the first piston assembly 150 in a direction of the force of the spring 158, in response to motion of the cam 162, the cam follower 164, and the rocker arm 160, causes linear movement of the piston 172 of the second piston assembly 170. Since the hydraulic fluid in the first pressure chamber 166, the actuator manifold 146 or 148, the return line 142 or 144, and the second pressure chamber 186 cannot be drained or otherwise relieved, the piston 172 of the second piston assembly 170 is moved in a direction opposite to the force of the spring 178. In turn, the plunger 174 of the second piston assembly 170 is urged downward against the rocker arm 180, which urges the exhaust valve 182 to an open position. The open position of the exhaust valve 182 allows compressed air to escape the cylinder 110 via the exhaust outlet 184, thereby performing an engine braking function. Thus, rotation of the cam 162 causes the exhaust valve 182 to open and close in a cyclical manner during the engine braking mode.

At times when the ECM 104 is not operated in the engine braking mode, the solenoid 208 is not energized and the braking control valve 114 is not actuated. When the braking control valve 114 is not actuated, the return spring 206 in the braking control valve 114 moves the spool valve 202 to the first position shown in FIG. 2. In the first position, the supply 118 of low pressure fluid is blocked from the actuation port 132, and the drain ports 138, 140 are in fluid communication with the engine fluid sump 126 via the vent port 124.

It should be appreciated that the operation and timing of the valve actuators 130 may be pre-selected to achieve a desired amount of engine braking. For example, in a 6-cylinder engine, each of the valve actuators 130 may open a corresponding exhaust valve 182 once during a 360° crankshaft rotation. Thus, during one crankshaft rotation, each of the six cylinders 110 will have contributed to the engine braking function. As discussed, the level of braking may be determined by the ECM 104 in response to a manual control command by the operator, a cruise control system command, or an automatic braking system command.

It will be apparent to those skilled in the art that various modifications and variations can be made in the engine braking system without departing from the scope of the invention. Other embodiments of the invention will be apparent to those skilled in the art from consideration of the specification and practice of the invention disclosed herein. It is intended that the specification and examples be considered as exemplary only.

What is claimed is:

1. An engine braking system for a multi-cylinder engine, comprising:

a supply of low pressure fluid;

an engine fluid sump;

a plurality of valve actuators, each of the valve actuators being configured to be alternatively fluidly coupled to the supply of low pressure fluid and the engine fluid sump, each valve actuator being operably coupled to at least one exhaust valve of a respective cylinder; and a braking control valve operably coupled to two of the valve actuators, the braking control valve being movable between a first position at which the two valve actuators are fluidly coupled to the engine fluid sump and blocked from the supply of low pressure fluid and a second position at which the two valve actuators are fluidly coupled to the supply of low pressure fluid and blocked from the engine fluid sump.

2. The engine braking system according to claim 1, further including a check valve associated with each of the two valve actuators, each check valve being configured to prevent fluid flow from the respective valve actuator to the supply of low pressure fluid.

3. The engine braking system according to claim 1, wherein the braking control valve includes a supply port fluidly coupled to the supply of low pressure fluid.

4. The engine braking system according to claim 3, wherein the braking control valve includes a spool valve slidable in a valve body.

5. The engine braking system according to claim 4, wherein the spool valve is an electrically-actuated spool valve.

6. The engine braking system according to claim 5, wherein the braking control valve includes a solenoid configured to selectively actuate the spool valve.

7. The engine braking system according to claim 4, wherein the braking control valve further includes a spring arranged to urge the spool valve to a first position.

8. The engine braking system according to claim 7, wherein the braking control valve further includes a first drain port and a second drain port, the first drain port fluidly coupling a first valve actuator with the engine fluid sump and the second drain port fluidly coupling a second valve actuator with the engine fluid sump when the spool valve is urged to the first position by the spring.

9. The engine braking system according to claim 8, wherein the spool valve is moved to a second position when actuated.

10. The engine braking system according to claim 9, wherein the braking control valve includes an actuation port fluidly coupled with the valve actuators, the actuation port being fluidly coupled with the supply port when the spool valve is actuated to the second position.

11. The engine braking system according to claim 10, wherein fluid communication between the first drain port and the first valve actuator and between the second drain port and the second valve actuator is blocked when the spool valve is actuated to the second position.

12. The engine braking system according to claim 11, wherein the braking control valve further includes a vent port configured to fluidly couple the first drain port and the second drain with the engine fluid sump when the spool valve is in the first position.

13. The engine braking system according to claim 12, wherein the valve spool includes a longitudinal bore fluidly coupled to the vent port, a first annulus associated with the first drain port and fluidly coupled to the longitudinal bore via at least one radial bore corresponding to the first annulus, and a second annulus associated with the second drain port and fluidly coupled to the longitudinal bore via at least one radial bore corresponding to the second annulus.

14. The engine braking system according to claim 1, including a hydraulic manifold coupled to the braking control valve, the hydraulic manifold being fluidly coupled to at least one of the exhaust valve actuators.

15. The engine braking system according to claim 1, further including an electronic control module configured to control timing of actuation and de-actuation of the braking control valve with respect to a piston top-dead-center position in a cylinder.

16. An engine braking method for a multi-cylinder engine wherein compressed air from the compression stroke of a cylinder is used for engine braking and the compressed air is released through a cylinder exhaust valve near a piston top-dead-center position, the method comprising:

supplying fluid from a supply of low pressure fluid to a braking control valve; and selectively controlling movement of the braking control valve between a first position at which two valve actuators are fluidly coupled to an engine fluid sump and blocked from the supply of low pressure fluid and a second position at which the two valve actuators are fluidly coupled to the supply of low pressure fluid and blocked from the engine fluid sump, each of the valve actuators operably coupled to an exhaust valve of a different cylinder.

17. The engine braking method according to claim 16, further including preventing fluid flow from the valve actuators to the supply of low pressure fluid via the braking control valve.

18. The engine braking method according to claim 16, wherein said selectively controlling includes actuating a spool valve such that the spool valve slides in a valve body of the braking control valve from a first position to a second position.

19. The engine braking method according to claim 16, further including opening at least one of said exhaust valves when a piston is near a top-dead-center position in a cylinder.

20. An engine braking system for two cylinders of a multi-cylinder engine, comprising:

a supply of low pressure fluid;

an engine fluid sump;

two valve actuators, each valve actuator operably coupled to a different one of the two cylinders, each of the valve actuators being configured to be alternatively fluidly coupled to the supply of low pressure fluid and the engine fluid sump;

a braking control valve operably coupled to the two valve actuators, the braking control valve being movable between a first position at which the two valve actuators are fluidly coupled to the engine fluid sump and blocked from the supply of low pressure fluid and a second position at which the two valve actuators are fluidly coupled to the supply of low pressure fluid and blocked from the engine fluid sump;

a check valve associated with each of the two valve actuators, each check valve being configured to prevent fluid flow from a respective valve actuator to the supply of low pressure fluid; and at least one exhaust valve operably coupled to each of the two valve actuators.

* * * * *